US006007956A

United States Patent [19]

Yasunaga et al.

[11] Patent Number: 6,007,956

[45] **Date of Patent: *Dec. 28, 1999**

[54] CARRIER AND DEVELOPER FOR DEVELOPING ELECTROSTATIC LATENT IMAGES

[75] Inventors: Hideaki Yasunaga, Sakai; Tomoharu Nishikawa, Osaka; Koichi Takenaka, Itami; Hiroshi Shibano, Takarazuka, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/589,081

[22] Filed: Jan. 23, 1996

[30] Foreign Application Priority Data

Feb. 3, 1995 [JP] Japan ..... 7-039245

[51] Int. Cl.[6] ..... G03G 9/107

[52] U.S. Cl. ..... 430/106.6; 430/108; 430/111; 430/137; 428/407

[58] Field of Search ..... 430/106.6, 108, 430/111, 137; 428/407

[56] References Cited

U.S. PATENT DOCUMENTS

| | | | |
|---|---|---|---|
| 4,600,675 | 7/1986 | Iwasa et al. | 430/106.6 |
| 4,609,607 | 9/1986 | Takagi et al. | 430/106.6 |
| 4,822,708 | 4/1989 | Machida et al. | 430/106.6 |
| 4,822,709 | 4/1989 | Ohtani et al. | 430/106.6 |
| 4,847,176 | 7/1989 | Sano et al. | 430/106.6 |
| 4,868,082 | 9/1989 | Kohri et al. | 430/106.6 |
| 5,482,806 | 1/1996 | Suzuki et al. | 430/106.6 |

FOREIGN PATENT DOCUMENTS

| | | | |
|---|---|---|---|
| 0576893 | 1/1994 | European Pat. Off. | 430/106.6 |
| 1-270061 | 10/1989 | Japan | 430/106.6 |

OTHER PUBLICATIONS

Patent & Trademark Office English–Language Translation of TP 4–102865 (Pub. Apr. 1992).

APILIT; APILIT2 Abstract 94:5276, DN 4131246 (1994) of Journal of Catalysis V146 N.2 449–59 (Apr. 1994).

CAPLUS Abstract 1994:204617, DN 120:204617 (1994) of JP 05281785 (Oct. 1993).

Patent & Trademark Office English Translation of JP 1–270061 (Pub Oct. 27, 1989).

Weast, Robert, ed. CRC Handbook of Chemistry & Physics, 52nd Edition (Jul. 1991) p. B–99.

*Primary Examiner*—Janis L. Dote

*Attorney, Agent, or Firm*—Burns, Doane, Swecker & Mathis, LLP

[57] ABSTRACT

The present invention relates a carrier comprising: a core particle comprising a binder resin and a first magnetic powder dispersed therein; and a second magnetic powder adhered onto the surface of the core particle, said second magnetic powder having a relative surface area larger than that of the first magnetic powder.

17 Claims, 2 Drawing Sheets

CARRIER AND DEVELOPER FOR DEVELOPING ELECTROSTATIC LATENT IMAGES

BACKGROUND OF THE INVENTION

1. Field of the Invention

The present invention relates to a carrier for developing electrostatic latent images formed on an image-bearing member such as a photosensitive member in image forming apparatus such as copying machines, printers and the like, and specifically relates to a binder-type carrier having magnetic powder dispersed in resin for developing electrostatic latent images.

2. Description of the Related Art

Conventionally, in image forming apparatuses such as copying machines, printers and the like, an electrostatic latent image formed on an image-bearing member such as a photosensitive member is commonly developed using a mixture of carrier and toner as a developer.

Examples of well-known carriers mixed with toner include conventional powders such as iron, ferrite and the like used directly, as well as binder-type carriers having such magnetic powder dispersed in resin.

Carriers that use iron, ferrite or the like directly generally have low electrical resistance which results in disadvantages when such carriers are used for developing inasmuch as the electrical load on the surface of the image-bearing member flows through the carrier and produces white spots in the developed image, and the carrier adheres to the image-bearing member due to the electrical load injected from the developing sleeve. Furthermore, the head of the magnetic brush formed by such carriers are generally hard, leading to disadvantages such as streaks when developing halftone images such as photographic documents and the like.

Thus, in recent years attention has focused on the aforesaid binder-type carriers wherein magnetic powder is dispersed in resin.

Such binder-type carriers having magnetic powder dispersed in resin typically have a weak magnetic force, however, which weakens the magnetic restraint exerted on said carrier by a magnetic roller or the like, such that the carrier is released from the developing sleeve and adheres to the image-bearing member. Disadvantages arise from this situation such as generation of noise in formed images, and damage to the image-bearing member caused by adhered carrier and the like.

When large a large amount of magnetic powder dispersed in resin is included in carriers of the aforesaid binder type, therefore, much of said magnetic powder may be exposed on the surface of the carrier and reduce the resistance value of the carrier. During development, the electrical charge on the image-bearing member may flow through the carrier and produce undeveloped white spots in the formed image. Furthermore, bonding between the resin and magnetic powder may be adversely affected by the large content of magnetic powder, thereby causing the carrier to readily breakdown.

Heretofore, carriers have been developed which provide a surface coat of resin over the entire surface of a binder-type carrier having a large amount of magnetic resin powder dispersed in resin, such as disclosed in Japanese Unexamined Patent Application No. SHO 58-59457. The provision of a resin surface coating suppresses the breakdown of the binder-type carrier, and the addition of electrically conductive or charge-control agents to said surface coating allows the resistance value of the entire carrier to be regulated, as well as to regulate chargeability relative to the toner.

When a resin surface coating is provided on the entire surface of a binder-type carrier, however, the surface of the carrier is formed by a composite surface of resin and magnetic powder which has numerous charge points relative to the toner, thus losing an advantage of the binder-type carrier which has durability with respect to spent carrier, and becoming unable to suitably charge the toner. The addition of agents having conductive properties and charge-controlling properties to the resin surface coating is disadvantageous inasmuch as it is troublesome and complicated, and increases production costs.

SUMMARY OF THE INVENTION

An object of the present invention is to eliminate the previously described disadvantages by providing a carrier and developer for developing electrostatic latent images formed on an image-bearing member such as a photosensitive member in image forming apparatuses such as copying machines, printers and the like.

That is, an object of the present invention is to provide a binder-type carrier having magnetic powder dispersed in resin for developing electrostatic latent images, said carrier being capable of stable charging of the toner even when a high density of magnetic powder is loaded in the resin, and the electrical resistance value of the carrier is suitably regulated to minimize carrier fatigue resulting from spent carrier so as to be capable of suitably charging toner over long-term use and allow reliable formation of excellent images.

The carrier and developer of the present invention for developing electrostatic latent images eliminates the previously described disadvantages by providing a binder-type carrier having magnetic powder dispersed in resin for developing electrostatic latent images and a developer containing said carrier, wherein the relative surface area of magnetic powder adhered to the surface of said carrier particles is greater than the relative surface of magnetic powder dispersed therein.

Figure 1:
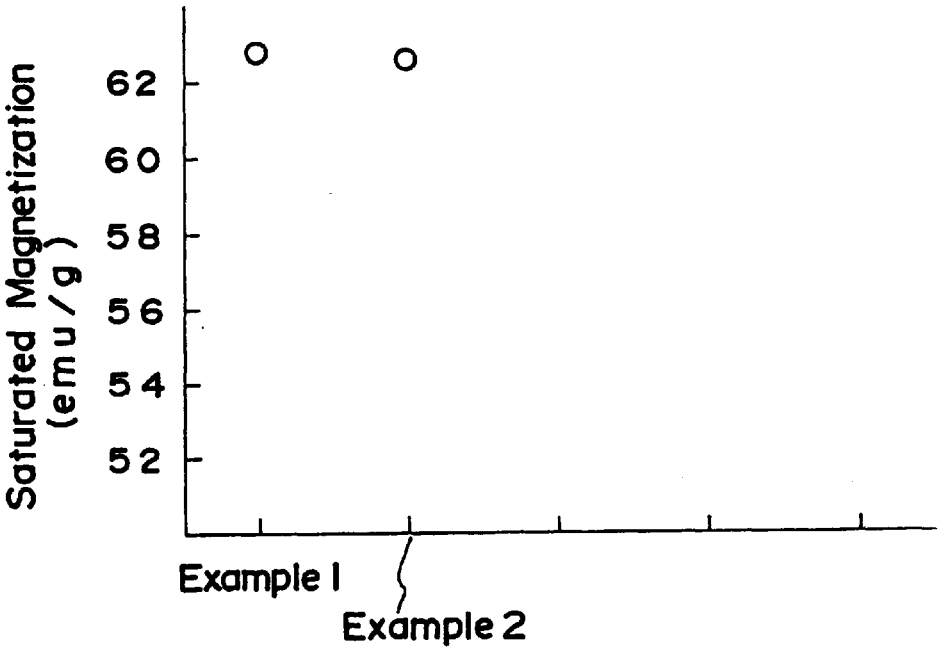
FIG. 1 is a graph showing the carrier saturated magnetization states of the carriers of examples 1 and 2.

The present invention will be fully described hereinafter by way of preferred embodiments and with reference to the accompanying drawings.

DETAILED DESCRIPTION OF THE PREFERRED EMBODIMENTS

In the carrier for developing electrostatic latent images of the preferred embodiments of the present invention, the magnetic powder dispersed in resin is a magnetic powder having a small relative surface area so that a large amount of magnetic powder can be included in the resin. It is desirable that the relative surface area the magnetic powder is within the range of 1.0~7.0 $m^2/g$. On the other hand, the magnetic powder adhered to the surface of the carrier particles having magnetic powder dispersed in resin has a large relative surface area preferably within a range of 8.0~12.0 $m^2/g$, and more preferably within a range of 8.0~10.0 $m^2/g$, to suppress the amount of exposure of the magnetic powder on the surface of the carrier particles and achieve a suitable carrier resistance value.

The content of magnetic particles having a small relative surface area is desirably 60~90 percent-by-weight, and preferably 80~90 percent-by-weight, relative to the resin particles containing dispersed magnetic powder. When the aforesaid magnetic powder content is less than 60 percent-by-weight, the obtained carrier has a weak magnetic force, such that during development the carrier adheres to the image-bearing member and produces noise in the formed image, and the image-bearing member is damaged by the adhered carrier. When the aforesaid magnetic powder content exceeds 90 percent-by-weight, it becomes difficult to accomplish the kneading necessary to uniformly disperse the magnetic powder in the resin.

The content of magnetic particles having a large relative surface area adhered to the surface of the carrier particles cannot be discussed unconditionally due to variations of the carrier particle size, amount of magnetic powder contained in the carrier and the like, but an amount in the range of 50~200 parts-by-weight relative to 100 parts-by-weight of the resin comprising the carrier is desirable. That is, when the amount of magnetic powder adhered to the surface of the carrier particles is within the aforesaid range, the carrier resistance value is not reduced, and the charging points on the surface of the carrier can be increased.

Adhering the magnetic powder having a large relative surface area to the surface of the carrier particles as previously described preferably is accomplished by fusing the magnetic powder having a large relative surface area to the surface of the carrier particles using an mechano-fusion system such as ONGU-mil (Hosokawa Micro, Ltd.), so as to force the magnetic powder having a small relative surface area dispersed in the resin into the interior portion of the carrier particles. For example, the mechano-fusion system is accomplished by passing a mixture comprising a core carrier particle and magnetic powder into a space formed between the inner surface of a rotating cylinder and a chip member having a curvature smaller than that of the rotating cylinder, thereby the magnetic powder is adhered onto the surface of the core carrier particle. Thus, the magnetic powder having a small relative surface area is forced into the interior of the carrier particle regardless of the amount of said magnetic powder in the resin, thereby preventing a reduction of the electrical resistance value of the carrier particles. Furthermore, the reduction in the charging points produced when the magnetic powder having a small relative surface area is forced into the interior portion of the carrier particles is eliminated by adhering the magnetic powder having a large relative surface area to the surface of said carrier particles.

The method for adhering magnetic powder having a large relative surface area to the surface of the carrier particles is not limited to the previously described method, and may also be accomplished by using, for example, an air heating system such as a thermo-fusion system (Japan Pneumatic, Ltd.) or the like so as to thermally fuse the surface resin of the carrier particles and cover the magnetic powder having a small relative surface area dispersed in the resin with said fused resin, and fuse magnetic powder having a large relative surface area on the surface of the carrier particles. Such a process achieves similar effectiveness as the previously mentioned mechano-fusion system. From the perspective of yield, it is desirable that the carrier particles are manufactured using the previously mentioned mechano-fusion system.

In the aforesaid carrier particles, the magnetic powder having a small relative surface area is packed at high concentration in the resin, whereas the magnetic powder having a large relative surface area on the surface of the carrier particles is adhered at spots in the resin.

It is desirable that the volume mean particle size of the carrier is from 15 to 70 micron.

In the carrier of the present invention for developing electrostatic latent images, a magnetic powder can be loaded at a high density in the carrier particles because a magnetic powder having a small relative surface area is dispersed in the resin, thereby eliminating the disadvantage of carrier adhering to the image-bearing member during development. Furthermore, a reduction of the resistance value of the carrier can be prevented despite the magnetic powder having a small relative surface area dispersed in the resin due to the decrease in the magnetic powder exposed on the surface of the carrier particles accomplished by entrapping the magnetic powder having a small relative surface area within the carrier particles.

It is desirable that the carrier of the present invention has a dynamic current value of less than 200 nA, and preferably less than 150 nA.

On the other hand, the charging points of the carrier particles can be increased and chargeability improved relative to the toner by adhering to the surface of the carrier particles a magnetic powder having a relative surface area greater than the magnetic powder dispersed in the resin, thereby inhibiting fatigue due to spent carrier.

Specific examples of the carrier of the present invention for developing electrostatic latent images are described below.

EXAMPLE 1

In the present example, binder-type carrier particles having magnetic powder dispersed in resin are obtained using ferrite having a relative surface area of 4.60 $m^2/g$ dispersed in resin, and using a polyester resin (TAFUTON NE1110; Kao, Ltd.), and adding carbon black (MOGARU L; Cabot, Ltd.), and silica (H2000; Hoechst). These constituents were mixed at a rate of 600 parts-by-weight ferrite, 100 parts-by-weight polyester resin, 2 parts-by-weight carbon black, and 1.5 parts-by-weight silica.

After the aforesaid materials were mixed using a henschel mixer, the mixture was kneaded in a pressure kneader, then the kneaded material was cooled, and thereafter coarsely pulverized by a feather mill, and finely pulverized by a jet mill. The pulverized material was then classified using a forced air classification device to obtain carrier particles having as volume mean particle size of 50 $\mu$m.

In the present example, 100 parts-by-weight of ferrite having a relative surface area of 9.67 $m^2/g$ was added as the magnetic powder having a relative surface area greater than the magnetic powder dispersed in resin relative to 703.5 parts-by-weight of carrier particles obtained above. After said materials were mixed using a henschel mixer, 3,000 g of the mixture were loaded in a thermo-fusion system (Japan Pneumatic Kogyo, K.K.) and heat processed at a temperature of 500° C., transport air of 8 nl/h, and heated air of 0.3 $Nm^3$/min to adhere the ferrite having a large relative surface area to the surface of the carrier particles and obtain a carrier wherein magnetic powder adhered to the surface of the carrier particles has a relative surface area greater than the magnetic powder dispersed in resin.

Thus, when the ferrite having a large relative surface area was adhered to the surface of the carrier particles as previously described, part of the magnetic powder having a relative surface area of 4.60 $m^2/g$ which was dispersed in resin but remained exposed on the surface of the particle was forced into the interior portion of the carrier particle, thereby reducing the surface area of the magnetic powder exposed on the surface of said carrier particle.

EXAMPLE 2

In this example, carrier particles containing magnetic powder having a relative surface area of 4.60 $m^2/g$ dispersed in resin were obtained in the same manner as described in example 1, and thereafter ferrite having a relative surface area of 9.67 $m^2/g$ identical to that used in example 1 was added in equal proportions. After the materials were mixed in a henschel mixer, the mixture was subjected to heat processing for 10 minutes to achieve frictional heat of 90° C. using an ONGU-mill (Hosokawa Micro, K.K.) to adhere the ferrite having a large relative surface area on the surface of the carrier particles, and obtain a carrier wherein magnetic powder adhered to the surface of the carrier particles has a relative surface area greater than the magnetic powder dispersed in resin.

Thus, when the ferrite having a large relative surface area was adhered to the surface of the carrier particles as previously described, the magnetic powder having a small relative surface area which was dispersed in resin but remained exposed on the surface of the particle was forced into the interior portion of the carrier particle, thereby reducing the surface area of the magnetic powder exposed on the surface of said carrier particle, in the same manner as in example 1. Furthermore, the small particles in the carrier were decreased by adhering the small size particles contained in the carrier particles to the surface of the carrier particles.

In example 1 the kneaded material was pulverized, and classified and the size of the various carrier particles was measured for volume distribution. The measurement results are shown in Table 1.

TABLE 1

| Particle size (μm) | Volume distribution (%) Example 1 |
|---|---|
| 4.00~5.04 | 0.0 |
| 5.04~6.35 | 0.0 |
| 6.35~8.00 | 0.0 |
| 8.00~10.1 | 0.0 |
| 10.1~12.7 | 0.0 |
| 12.7~16.0 | 0.8 |
| 16.0~20.2 | 3.3 |
| 20.2~25.4 | 8.0 |
| 25.4~32.0 | 13.0 |
| 32.0~40.3 | 20.4 |
| 40.3~50.8 | 23.7 |
| 50.8~64.0 | 20.4 |
| 64.0~80.6 | 7.8 |
| 80.6~102.0 | 2.7 |
| 102.0~128.0 | 0.0 |
| 128.0~161.0 | 0.0 |

In the case of the carrier of example 1 which used a magnetic powder having a relative surface area of 4.60 $m^2/g$ as the magnetic powder dispersed in resin, the volume distribution was high in the vicinity of 50 μm, and there were few particles either smaller or larger in the carrier.

In example 1 the yield was determined for the various resin particles having a magnetic powder distribution and mean particle size of 50 μm. The yield of the aforesaid particles was about 70% in example 1. Yields were poor when magnetic powder having a small relative surface area was used as the magnetic powder dispersed in resin.

Then, the saturated magnetization was measured in the carriers of the previously described examples 1 and 2; the measurement results are shown in FIG. 1.

In the carriers of examples 1 and 2 which used magnetic powders having small relative surface areas of 4.60 $m^2/g$ as the magnetic powder dispersed in resin, the saturated magnetization was 62 emu/g or greater, and adequate magnetic force was present which indicated there would be sufficient support by a magnetic force of the magnet roller or the like.

The dynamic current values were measured for the carriers of examples 1 and 2 using a measuring device manufactured by Minolta Co., Ltd. The measurement device is shown in FIG. 2.

Figure 2:
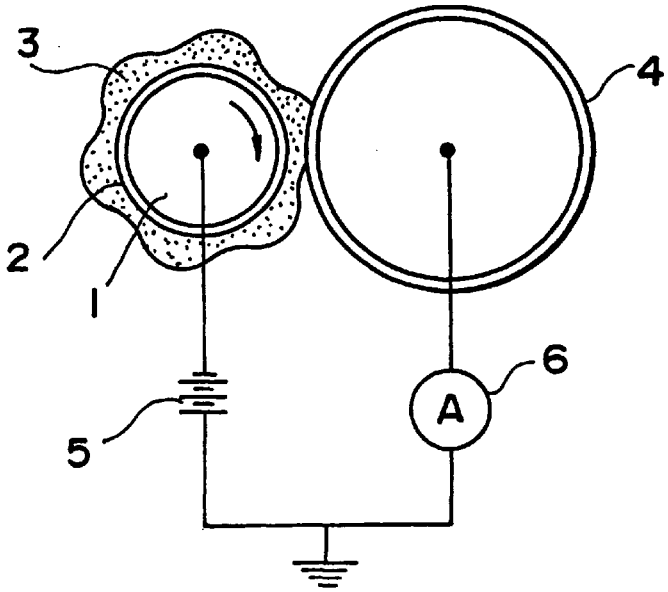
FIG. 2 briefly shows how the carrier dynamic current value is measured.
Figure 3:
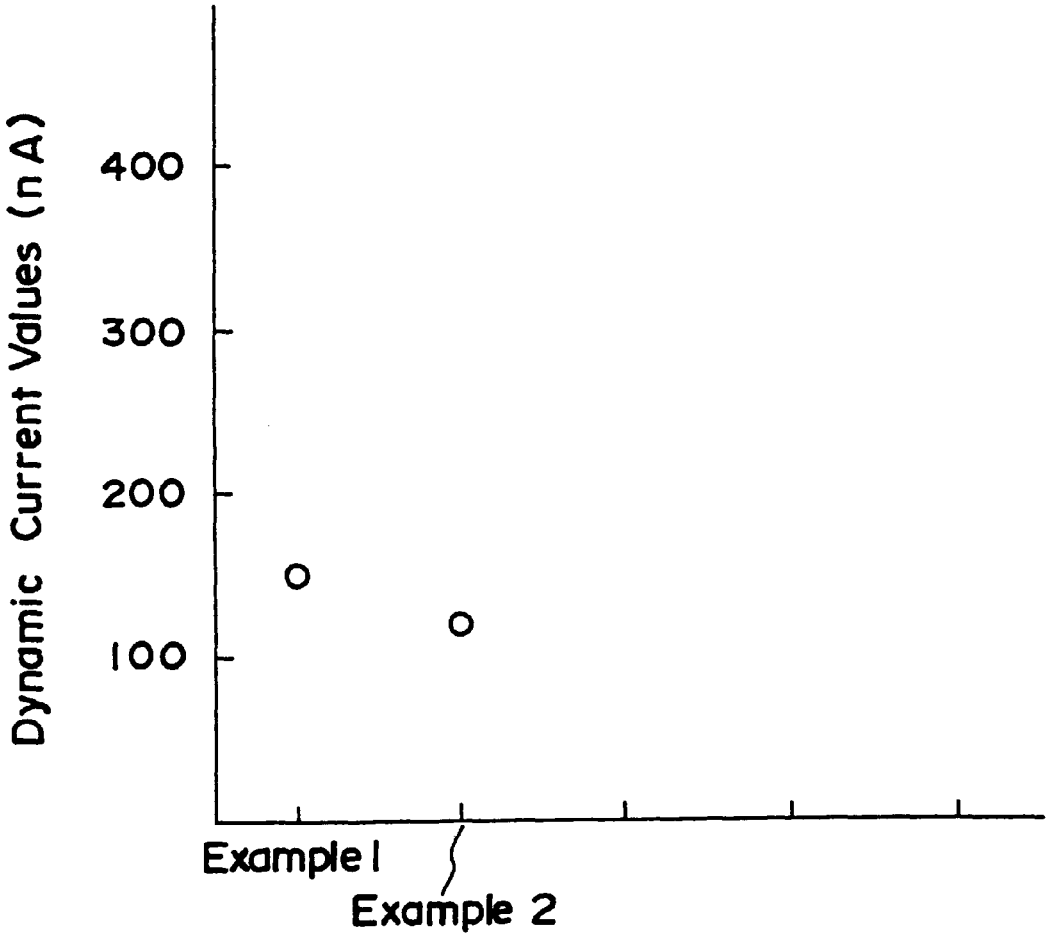
FIG. 3 is a graph showing the dynamic current values of the carriers of examples 1 and 2.

Measurement of the dynamic current value of each carrier was accomplished by using, as shown in FIG. 2, an internal magnet roller 1 to supply 5 g of carrier 3 on sleeve roller 2 having a magnetic flux density of 1,000 Gauss, and setting the spacing between said sleeve roller 2 and an electrode tube 4 at 1 mm. The magnet roller 1 was rotated at a speed of 50 rpm, a bias voltage of 500 V was supplied from power source 5, and the current value flowing through carrier 3 to electrode tube 4 was measured by ammeter 6.

In the carriers of examples 1 and 2 wherein a magnetic powder having a relative surface area of 9.67 $m^2/g$ was adhered to the surface of the carrier particles, the dynamic current value flowing through the carrier was a low 100~150 nA.

The carriers of examples 1 and 2 were used in developer loading in a commercial copying machine (model Di 30; Minolta Co., Ltd.), and the amount of carrier contained in the toner collected by the cleaning device at the start (amount of carrier recollected) was measured, and toner charging stability and image defects in formed images after 50,000 copies were checked. The results are shown in Table 2 below.

The amount of recovered carrier was checked after 1,000 copies had been made, and an amount of recovered carrier of 0~80 mg was rated A, 80~120 mg was rated B, and over 120 mg was rated C. Image defects were evaluated by the presence/absence of non-developed white spots caused by developing bias leakage under environmental conditions of high temperature and high humidity, i.e., a temperature of 30° C. and 80% humidity, which readily induce developing bias leaks; the absence of white spots was rated A, and the presence of white spots was rated C. Toner charging stability was checked under environmental conditions of high temperature and low humidity, i.e., a temperature of 30° C. and 30% humidity, and the state of background fog in images was examined when toner was continuously resupplied. A test chart having a 50% black-to-white (B/W) ratio was used to make 500 continuous copies, and thereafter background fogging on the copied image on white sheets was examined. No background fog was rated 5, slight fog presenting no problem from a quality standpoint was rated 4, fog at the lowest level permissible was rated 3, fog presenting a quality problem was rated 2, and excessive fog was rated 1.

TABLE 2

| | Ex. 1 | Ex. 2 |
|---|---|---|
| Amt. of Recovered Carrier | A | A |
| Image Defects | A | A |
| Charge Stability | 4 | 5 |

As can be understood from the data above, when the carrier used was the carriers for developing electrostatic latent images of examples 1 and 2 wherein the magnetic powder adhered to the surface of the carrier particles was the a magnetic powder having a large relative surface area greater than the magnetic powder dispersed in resin, carrier adhesion to the image-bearing member was minimal and the amount of carrier recovered by the cleaning device was slight, thereby minimizing the generation of noise in the formed images, as well as damage to the image-bearing member induced by adhered carrier. Furthermore, when the carriers for developing electrostatic latent images of examples 1 and 2 were used, excellent images were reliably obtained without non-developed white spots in the formed images caused by the charge on the image-bearing member flowing through the carrier, and without background fog in the formed images caused by unstable toner charging.

As previously described, the carrier of the present invention for developing electrostatic latent images, used as the magnetic powder dispersed in resin a magnetic powder having a relative surface area smaller than that of the magnetic powder adhered on the surface of the carrier particles, thereby allowing magnetic powder to be loaded at high density in the carrier particles and providing adequate magnetic force to minimize the amount of carrier adhering to the image-bearing member during development. Furthermore, adhering to the surface of the carrier particles a magnetic powder having a relative surface area larger than that of the magnetic powder dispersed in resin allows suitable regulation of the resistance value of the carrier and suppresses carrier fatigue caused by spent carrier.

When developing was accomplished using the carrier of the present invention for developing electrostatic latent images, no noise was generated in the formed images by carrier adhering to the image-bearing member, nor was there damage to the image-bearing member by adhered carrier. Furthermore, carrier fatigue due to spent carrier was minimal, thereby allowing suitable charging of toner over a long period and reliably forming excellent images.

Obviously, many modifications and variations of the present invention are possible in light of the above teachings. It is therefore, to be understood that within the scope of the appended claims, the invention may be practices other than as specifically described.

What is claimed is:

1. A carrier comprising:

a core particle comprising a binder resin and a first magnetic powder dispersed therein; and a second magnetic powder fused to the surface of the core particle, said second magnetic powder having a relative surface area larger than that of the first magnetic powder, wherein the carrier has a dynamic current value of 200 nA or less under 500 volts and a magnetic flux density of 1,000 Gauss.

2. The carrier of claim 1 wherein the relative surface area of the first magnetic powder is from 1.0 to 7.0 $m^2/g$.

3. The carrier of claim 1 wherein the relative surface area of the second magnetic powder is from 8.0 to 12.0 $m^2/g$.

4. The carrier of claim 1 wherein the amount of the first magnetic powder is from 60 to 90 weight % with respect to the core particle.

5. The carrier of claim-4 wherein the amount of the first magnetic powder is from 80 to 90 weight % with respect to the core particle.

6. The carrier of claim 1 wherein the volume mean particle size of the carrier is from 15 to 70 micron.

7. The carrier of claim 1 wherein the dynamic current value of the carrier is 150 nA or less.

8. The carrier of claim 1 wherein said carrier is prepared by the step of mixing the core particle and the second magnetic powder, and fusing the second magnetic powder onto the core particle by a mechano-fusion system in which the mixture is passed through a space formed between the inner surface of a rotating cylinder and a chip member having a curvature smaller than that of the rotating cylinder.

9. The carrier of claim 1 wherein said carrier is prepared by the step of mixing the core particle and the second magnetic powder, and fusing the second magnetic powder onto the core particle by a heat-fusion system in which the mixture is heated in order to fuse the second magnetic powder onto the core particle.

10. A carrier comprising:

a core particle comprising a binder resin and a first magnetic powder dispersed therein, the amount of the first magnetic powder being from 60 to 90 weight % with respect to the core particle; and a second magnetic powder fused to the surface of the core particle, said second magnetic powder having a relative surface area larger than that of the first magnetic powder, the amount of the second magnetic powder being from 50 to 200 parts by weight with respect to 100 parts by weight of the binder resin of the core particle, wherein the carrier has a dynamic current value of 200 nA or less under 500 volts and a magnetic flux density of 1,000 Gauss.

11. The carrier of claim 10 wherein the dynamic current value of the carrier is 150 nA or less.

12. The carrier of claim 10 wherein the relative surface area of the first magnetic powder is from 1.0 to 7.0 $m^2/g$.

13. The carrier of claim 10 wherein the relative surface area of the second magnetic powder is from 8.0 to 12.0 $m^2/g$.

14. A carrier comprising:

a core particle comprising a binder resin and a first magnetic powder dispersed therein; and a second magnetic powder fused to the surface of the core particle, said first magnetic powder having a relative surface area of 1.0 to 7.0 $m^2/g$ and said second magnetic powder having a relative surface area of 8.0 to 12.0 $m^2/g$, wherein the carrier has a dynamic current value of 200 nA or less under 500 volts and a magnetic flux density of 1,000 Gauss.

15. The carrier of claim 14 wherein the amount of the first magnetic powder is from 60 to 90 weight % with respect to the core particle and the amount of the second magnetic powder is from 50 to 200 parts by weight with respect to 100 parts by weight of the binder resin of the core particle.

16. The carrier of claim 14 wherein said carrier is prepared by the step of mixing the core particle and the second magnetic powder, and fusing the second magnetic powder onto the core particle by a mechano-fusion system in which the mixture is passed through a space formed between the inner surface of a rotating cylinder and a chip member having a curvature smaller than that of the rotating cylinder.

17. The carrier of claim 14 wherein said carrier is prepared by the step of mixing the core particle and the second magnetic powder, and fusing the second magnetic powder onto the core particle by a heat-fusion system in which the mixture is heated in order to fuse the second magnetic powder onto the core particle.

* * * * *